US005465514A

United States Patent [19]

Ulysse

[11] Patent Number: 5,465,514

[45] Date of Patent: Nov. 14, 1995

[54] VARIABLE DECORATIVE PICTURE FRAME

[76] Inventor: Clark H. Ulysse, 3911-65th Ave. N., Brooklyn Cntr., Minn. 55428

[21] Appl. No.: 215,592

[22] Filed: Mar. 22, 1994

[51] Int. Cl.[6] ..... A47G 1/06

[52] U.S. Cl. ..... 40/152; 40/155; 40/156; 40/152.1

[58] Field of Search ..... 40/152, 155, 152.1, 40/156, 158.1

[56] References Cited

U.S. PATENT DOCUMENTS

| | | | |
|---|---|---|---|
| 1,253,847 | 1/1918 | Lynch | 40/152 |
| 4,062,140 | 12/1977 | Meyer et al. | 40/152 |
| 4,136,470 | 1/1979 | Barz | 40/152 |
| 4,986,013 | 1/1991 | Pollack | 40/156 X |
| 5,174,054 | 12/1992 | Politi | 40/152.1 X |
| 5,187,886 | 2/1993 | Wu et al. | 40/156 X |
| 5,197,213 | 3/1993 | Borden | 40/152 |

FOREIGN PATENT DOCUMENTS

| | | | |
|---|---|---|---|
| 3805511 | 8/1989 | Germany | 40/152 |

*Primary Examiner*—Kenneth J. Dorner
*Assistant Examiner*—James O. Hansen
*Attorney, Agent, or Firm*—Leo Gregory

[57] ABSTRACT

This invention relates to a variably decorative picture frame having semi-cylindrical about the face thereof wherein are disposed cylindrical tubes adapted to have therein decorative material in harmony with the decor or environment in which the frame is placed, the same being readily changeable as may be desired or required.

5 Claims, 4 Drawing Sheets

VARIABLE DECORATIVE PICTURE FRAME

BACKGROUND OF THE INVENTION

1. Field of Invention

This invention relates to a readily assembled variably decorative self standing picture frame.

2. Description of the Previous Art

Picture framing represents a very active art and the same here is restricted to self standing frames of medium size such as would be present on mantles and perhaps more particularly on dressers and on end tables as in a living room.

These are generally rectangular of medium size and may be made to have wood or metal frames and perhaps in the present age, perhaps of a plastic material.

There is a present tendency to make frames decorative and ornamental. Further frames are being made to be readily taken apart and readily assembled not only for a possible change of the disclosure therein but for a change in the appearance and decorative effect of the frame.

SUMMARY OF THE INVENTION

It is a principal object herein to provide a fairly medium sized rectangular frame having a decorative appearance which can readily be varied to coordinate or harmonize with the decorative environment of a room.

It is another object herein to provide a picture frame which can be readily taken apart for a change in its decorative appearance perhaps to better harmonize with the character of the person or thing framed.

It is also an object to provide a frame with a basic rectangular structure having recessed side and front end walls and disposed in said recessed walls are cylindrical tubes of transparent material adapted to receive therein varied changeable decorative enclosures.

These and other objects and advantages will be set forth in the following description made in connection with the accompanying drawings and in which like reference numerals refer to similar parts throughout the several views.

DESCRIPTION OF A PREFERRED EMBODIMENT

Figure 1:
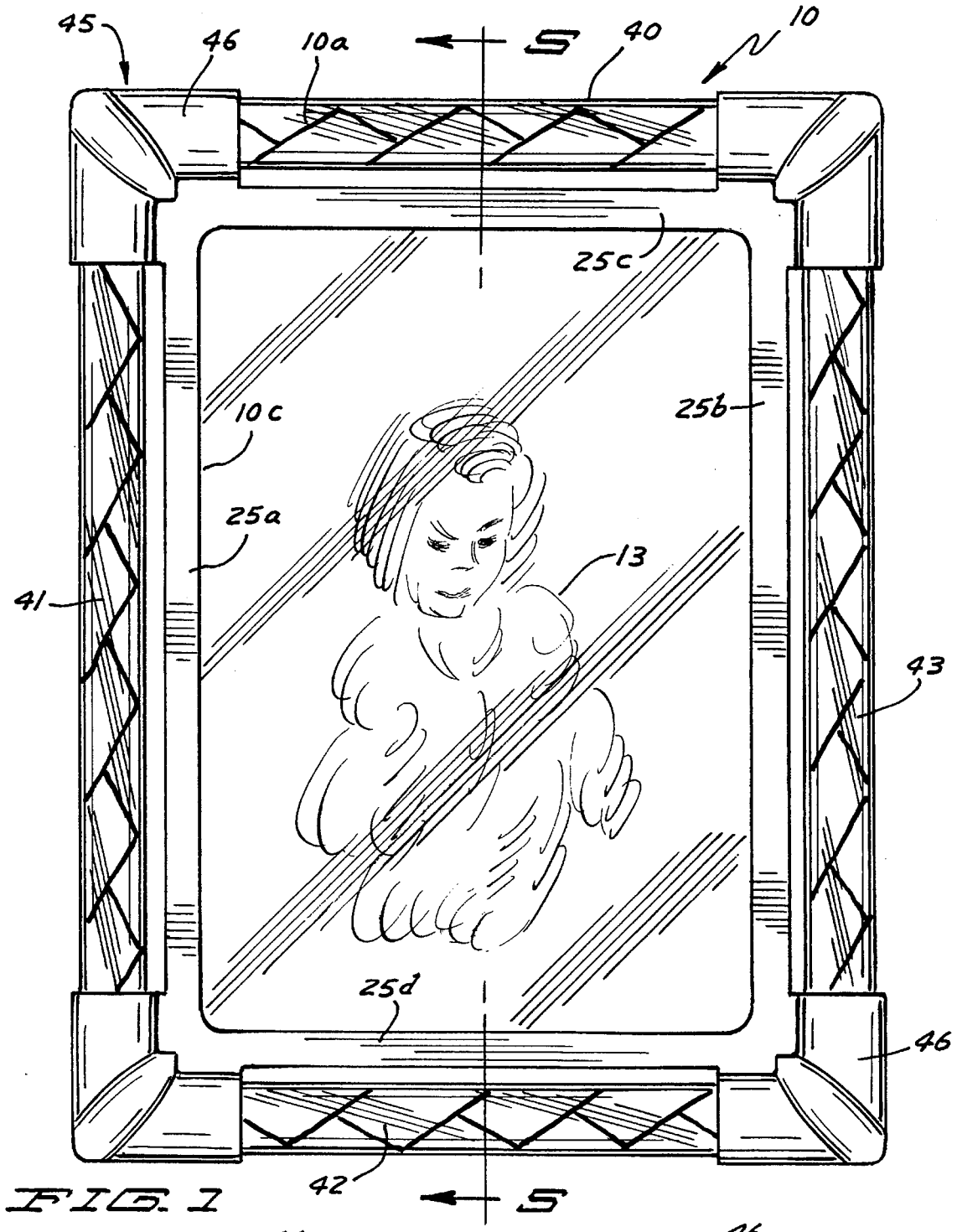
FIG. 1 is a front plan view.
Figure 2:
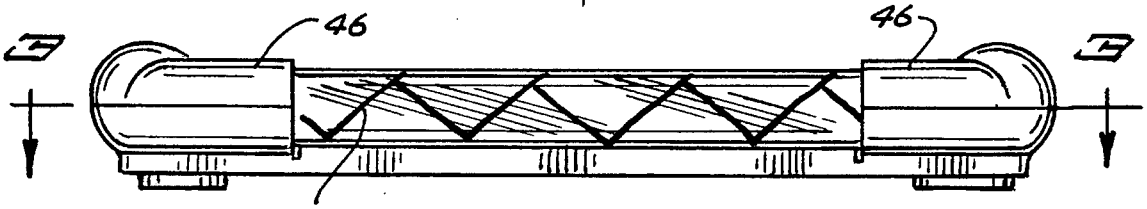
FIG. 2 is an end elevational view.

Referring to FIG. 1, a frame 10 rectangular in plan is shown having a front side 10*a* and a rear side 10*b* and a central rectangular opening 10*c*. Said rear side has side walls 11*a* and 11*b* and end walls 11*c* and 11*d*, the same having inwardly stepped or recessed side and end walls 11*e*, 11*f*, 11*g* and 11*h* respectively about said opening. Said last mentioned stepped walls are recessed sufficiently to receive a glass plate 12, a suitable illustration 13, a protective backing layer and backing member 15 having a pedestal 16 hinged thereto by a hinge 17 and the same is swingable outwardly thereof to support the frame in an upright position.

Holding said backing in said recessed position are a pair of opposed semi-circular headed studs 19 having depending stems 19*a* disposed into bores 20 in the middle of the walls 10*b* and 10*c* for frictional engagement therein. Said studs each have a recessed slot 19*b* for easy turning as with a coin edge. The circular portion of each overlies the backing member 15 holding the same in its recessed position.

Additional studs 21 similar to the studs 19 are disposed at each corner of the back side of said frame. Said studs 21 are circular except for a right angled niche 21*a* cut out of each stud and said studs have stems 21*b* disposed for frictional engagement in bores 22 recessed at each corner of the back of said frame. Said studs also have slots 21*c* recessed in the tops thereof for ease of turning said studs. The circular portions of said studs 21 will overlie their respective corners of the backing member 15 and when turned to have the respective niches face the corners of the backing member, it is free to be removed.

Said front side 10*a* shows the front detail of said rear walls. At each corner of the front side of said frame are formed angled semi-cylindrical recesses 23, 24, 25 and 26 respectively having upstanding adjacent the outer corners thereof posts 23*a*, 23*b*, 23*c* and 23*d* which have open top axial bores 23*a*', 23*b*', 23*c*' and 23*d*' disposed therein to frictionally receive and engage pins to be disposed therein as will be described.

Said bores 22 above indicated are formed in posts 22*a* which extend upwardly of the front side of said frame as indicated at each corner thereof spaced inwardly of posts 23*a*–*d*.

Said front side 10*a* has upwardly projecting angled walls 25*a*, *b*, *c* and *d* spaced inwardly from the outer perimeter of said frame and the same are formed by said recessed rear side and end walls. Said projecting walls define therebetween said rectangular open space 10*c* through which said glass plate and illustration are disclosed.

Extending between said angled corner recesses adjacent the outer sides and ends of said projecting walls are pairs of parallel upwardly projecting ribs 30 and 30*a* at each side and at each end 31*a*—31*a* and 31*c*–31*d* respectively.

Midway along the angled walls 25*a*–25*d* are cylindrical tubes 40–43.

Said ribs 30 and 31 form in effect side troughs 34 and end troughs 36 into which are disposed said cylindrical tubes 40–43. Said tubes are each of a length to extend into adjacent end portions of said angled semi-cylindrical corner recesses. Said cylindrical tubes preferably are formed of clear transparent plastic or like material the same to have respectively disposed therein and frictionally retained therein cylindrical tubes 50 having decorative exteriors for providing an attractive frame like enclosure about said opening 10*c*.

Releasably retaining said tubes 40–43 in position as described are corner retainers 45, the same being identical and interchangeable, only one reference numeral is being used.

Figure 3:
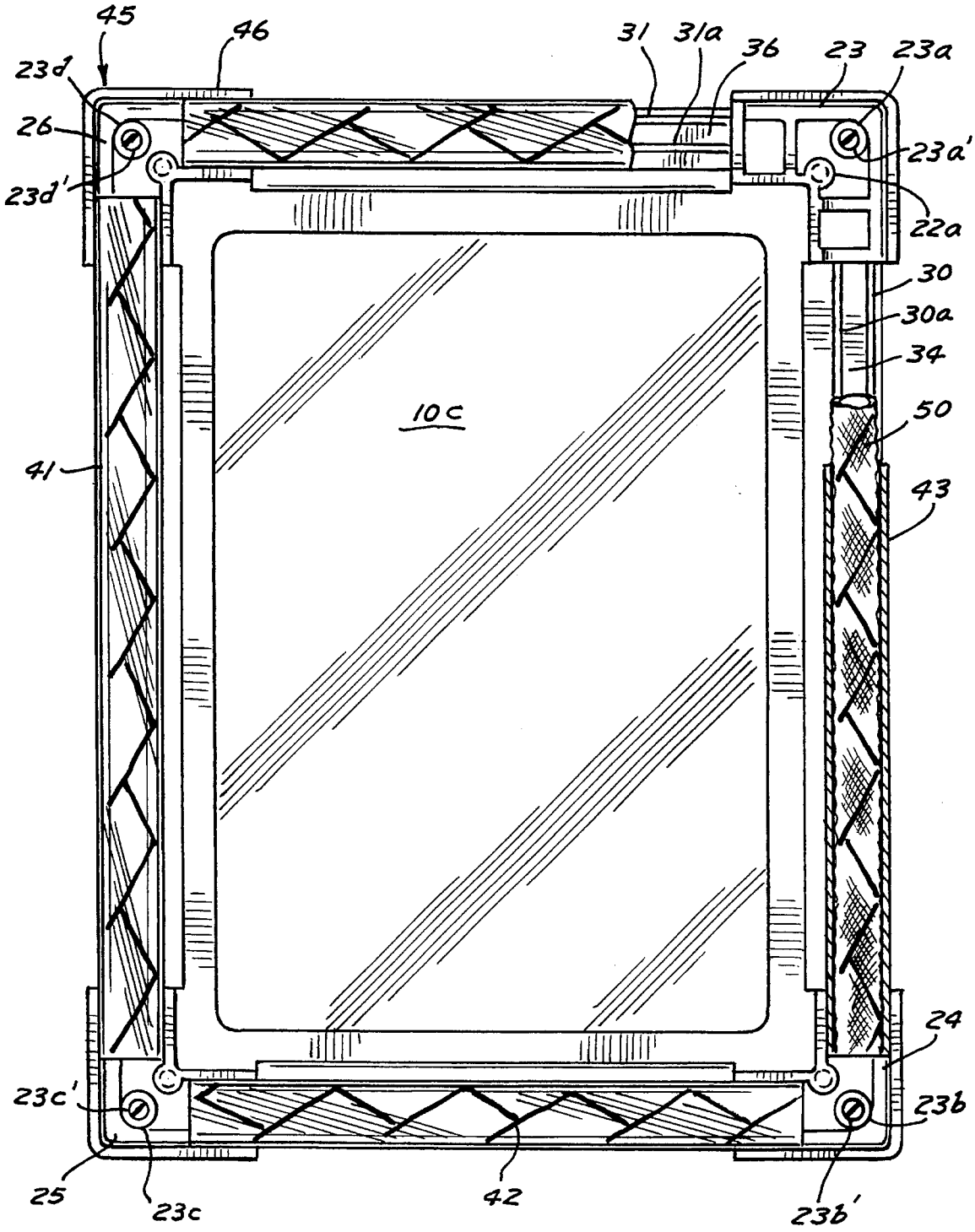
FIG. 3 is a view in horizontal section taken on line 3—3 of FIG. 2 with portions broken away.
Figure 4:
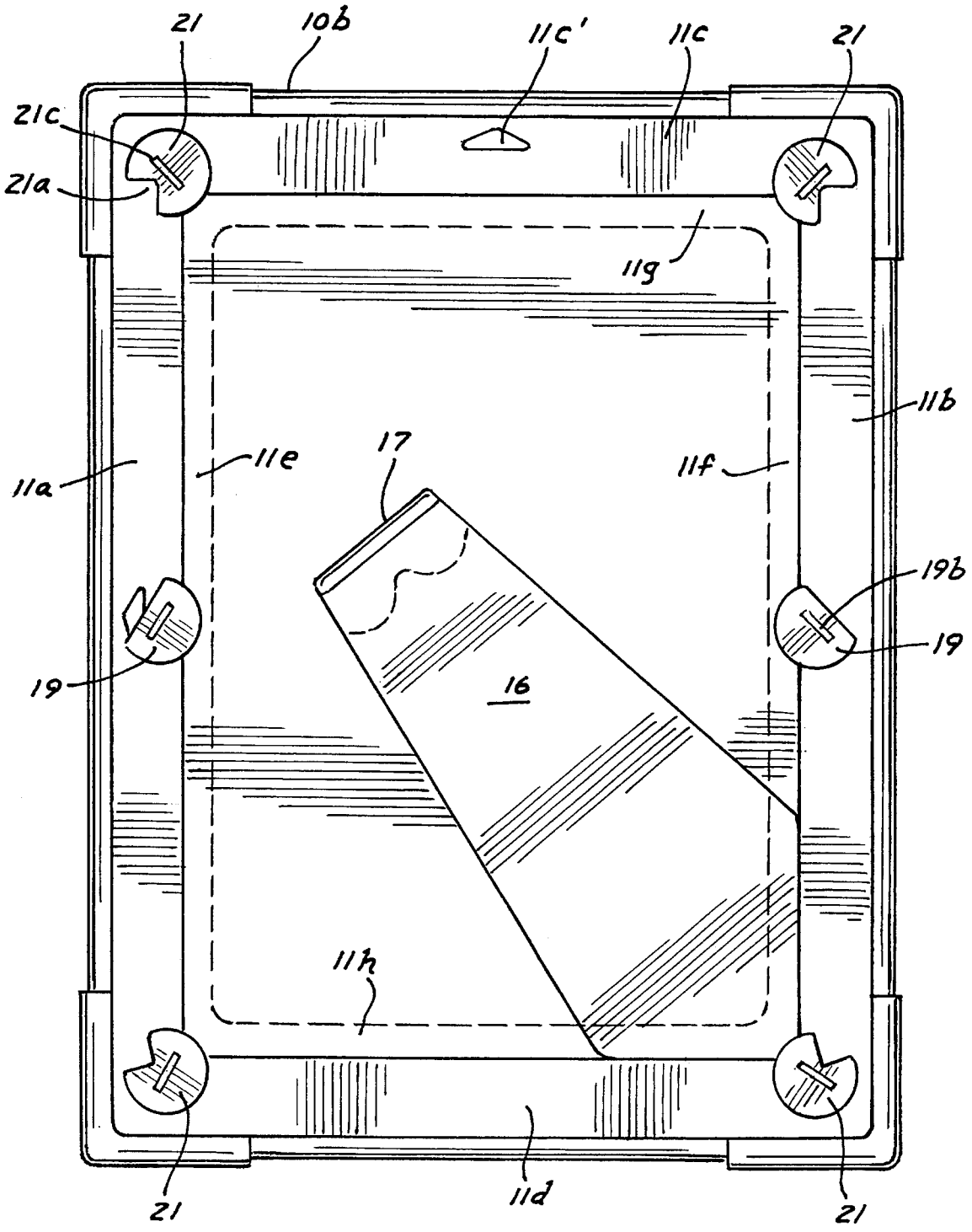
FIG. 4 is a rear plan view.
Figure 5:
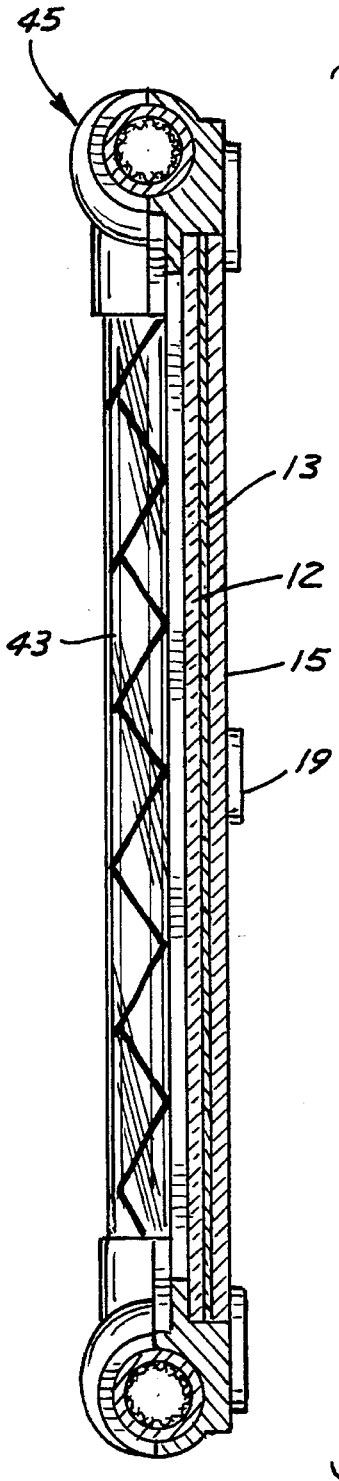
FIG. 5 is a view in longitudinal section taken on line 5—5 of FIG. 1 as indicated.
Figure 6:
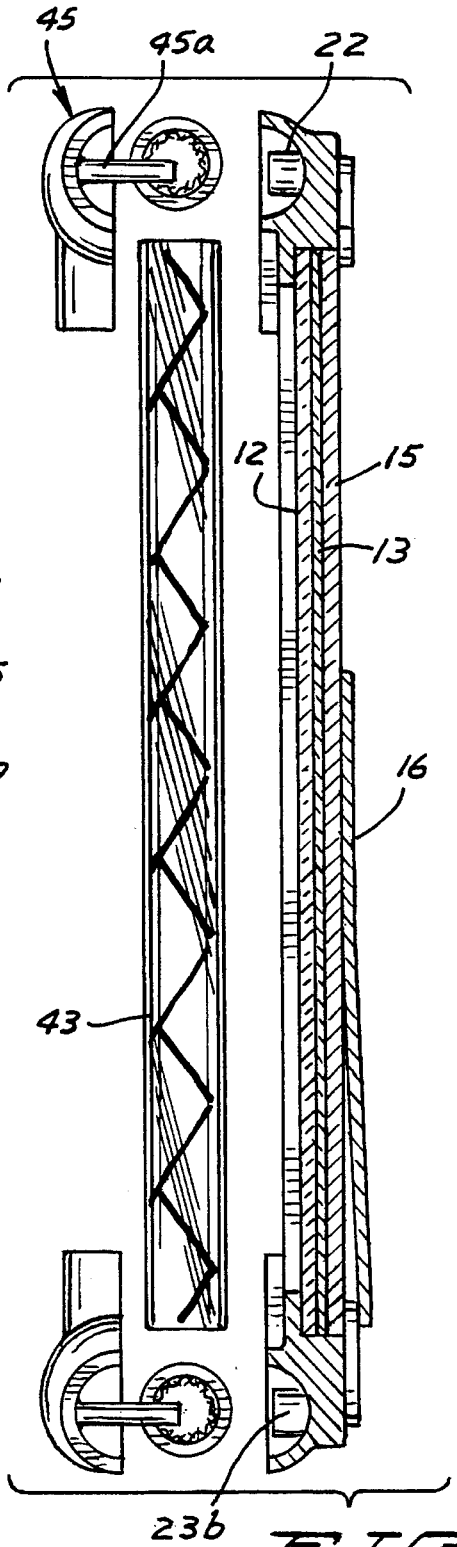
FIG. 6 is an exploded view similar to that of FIG. 5.
Figure 7:
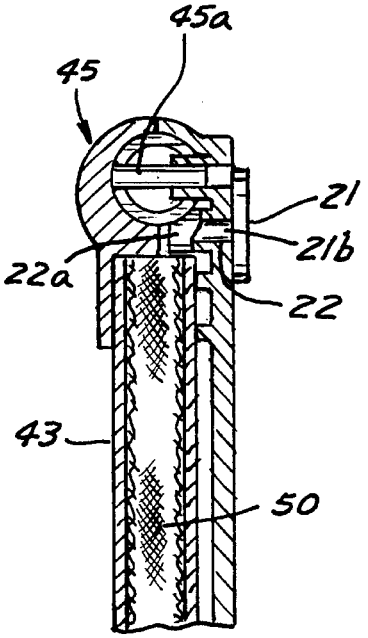
FIG. 7 is a broken view in vertical section showing in detail a corner assembly.

Said retainers as shown in FIG. 3, comprise right angled body portions 46 semi-cylindrical in cross section adapted respectively to overlie said angled corner recesses 23–26. Each retainer has depending therefrom centrally thereof a stem 45*a* which are disposed to be received respectively into said bores 22 to be frictionally engaged and retained therein. Hence with said retainers removably secure for all useful purposes said cylindrical tubes 40–43 to provide an attractive perimeter for said frame 10.

Said end walls 11*c* which is the upper end wall has an aperture 11*c*' therethrough for hanging purposes in the event the pedestal 16 is not used.

The present disclosure of said frame indicates it is in black but it is understood that any color or combination of colors may be used.

It will of course be understood that various changes may be made in the form, details, arrangement and proportions of the device herein without departing from the scope of the invention which generally stated, consists in a device capable of carrying out the objects and purposes above set forth, in the parts and combination of parts disclosed and defined in the appended claims.

What is claimed is:

1. A unitary frame member structure comprising a front side, a rear side and having recessed side and end walls forming a picture display opening therebetween, a back wall including an outer side overlying said opening and having a supporting pedestal pivoted to said outer side, said recessed walls forming upwardly projecting side and end walls at the front side of said frame member, right angled recessed members at each corner of said front side, a transparent tube disposed upon each of said flanges having respective end portions extending into said angled recesses at each corner, decorative means inserted into said tubes, retainers adapted to overlie said corner recesses and extensions therein of said end portions of said tubes, and means securing said retainers.

2. The structure of claim 1, including a pair of headed stud members respectively adjacent a pair of opposed walls of the rear side of said frame member having a portion thereof adapted to overlie an edge portion of said back wall.

3. The structure of claim 1, including a stud member having a head portion at each corner of the rear side of said frame member having the head portion thereof overlying an adjacent edge portion of said back wall.

4. A picture frame comprising a unitary frame member, said frame having recessed side and end rear walls forming a recessed picture display opening therebetween, a back wall overlying said recessed opening, means removably securing said back wall, front and side end walls of said frame member projecting upwardly resulting from said recessed side and end rear walls, a recessed right angled corner member forming each corner of said front side of said frame member, transparent tubes disposed upon said flanges between said corners, said tubes having end portions extending into said recesses, and a retaining member overlying each of said corner recesses and the respective end portions of said tubes therein.

5. The picture frame of claim 4, wherein each of said retaining members has a depending stem, and said corner recesses each have an upstanding post having an axial bore to frictionally retain a retainer stem therein.

* * * * *